US005747777A

United States Patent [19]

Matsuoka

[11] Patent Number: 5,747,777

[45] Date of Patent: May 5, 1998

[54] HEATER CONTROL DEVICE

[75] Inventor: Teruhiko Matsuoka, Chiba, Japan

[73] Assignee: Sharp Kabushiki Kaisha, Osaka, Japan

[21] Appl. No.: 628,128

[22] Filed: Apr. 4, 1996

[30] Foreign Application Priority Data

Apr. 7, 1995 [JP] Japan ..... 7-082975

[51] Int. Cl.[6] ..... H05B 1/02

[52] U.S. Cl. ..... 219/497; 219/505; 219/501; 395/23; 395/61; 395/900; 364/477.01

[58] Field of Search ..... 219/497, 501, 219/506, 508, 494, 505; 395/21, 23, 77, 900, 61, 76; 364/477.01, 477.04

[56] References Cited

U.S. PATENT DOCUMENTS

| | | | |
|---|---|---|---|
| 5,220,373 | 6/1993 | Kanaya . | |
| 5,267,348 | 11/1993 | Someya et al. | 395/61 |
| 5,287,154 | 2/1994 | Nakai et al. . | |
| 5,300,757 | 4/1994 | Hara et al. | 219/497 |
| 5,311,268 | 5/1994 | Ohzeki et al. . | |
| 5,465,320 | 11/1995 | Enbutsu et al. | 395/22 |
| 5,487,130 | 1/1996 | Ichimori et al. | 395/3 |

FOREIGN PATENT DOCUMENTS

| | | |
|---|---|---|
| 0402143 | 12/1990 | European Pat. Off. . |
| 310275 | 1/1991 | Japan . |
| 3-089369 | 4/1991 | Japan . |
| 473786 | 3/1992 | Japan . |
| 4178678 | 3/1992 | Japan . |
| 4303875 | 10/1992 | Japan . |
| 5-227338 | 9/1993 | Japan . |
| 5323830 | 12/1993 | Japan . |

*Primary Examiner*—Mark H. Paschall

*Attorney, Agent, or Firm*—David G. Conlin; William J. Daley, Jr.

[57] ABSTRACT

A heater on-time computing unit, provided in a heater control device, has a first fuzzy neural network for computing a heater on-time in accordance with a surface temperature of a heat fixing roller and a surface temperature change obtained from surface temperatures. A roller surface temperature predicting unit has the second fuzzy neural network for computing a predicted temperature of the heater in accordance with a surface temperature, a surface temperature change obtained from surface temperatures, and a heater on-time computed by the heater on-time computing unit. Thereby only roughly setting of parameters is required because the parameters are adjusted by sequential learning so that the optimal heater on-time is obtained. Therefore, the programming is simplified and it is possible to comply with differences in such as models, individuals, deterioration due to aging, and changes in environments.

15 Claims, 8 Drawing Sheets

HEATER CONTROL DEVICE

FIELD OF THE INVENTION

The present invention relates to a heater control device for controlling a heater employed in a heat fixing device or the like adopted for an electrophotographic image forming apparatus, such as a laser printer which uses laser beam to form an electrostatic latent image, a digital copying machine capable of processing an inputted original image, a conventional analog copying machine, and a plain-paper facsimile.

BACKGROUND OF THE INVENTION

The conventional electrophotographic image forming apparatus employs a heat fixing device 100, as shown in FIG. 10, to heat-fuse a toner image transferred onto a recording paper. According to the heat fixing device 100, a heater controlling circuit 107 controls a power supply which is provided by an AC power source 102 to a heater 105 through a thermal fuse 106 so as to maintain the heater 105 at a target temperature. The heater 105 is composed of a halogen lamp and others, and is provided inside the heat fixing roller 104.

There is provided with a temperature detecting unit 101, which is composed of a thermistor and others, in the vicinity of the heat fixing roller 104 to detect the surface temperature thereof. Depending on whether or not the surface temperature of the heat fixing roller 104 detected by the temperature detecting unit 101 exceeds a predetermined temperature, a controller 103 drives and controls the heater controlling circuit 107, thus enabling to maintain the heater 105 at the target temperature.

However, the conventional technology has the following problem. The controller 103 controls the on/off action of the heater 105 only based on a comparison result of the surface temperature of the heat fixing roller 104 detected by the temperature detecting unit 101 with the target temperature. But, it takes some time for the heat generated by the heater 105 to be conducted from the inside to the surface of the heater, and this is known as a heat response time. Thus, the surface temperature of the heat fixing roller 104 exceeds the target temperature when the heater 105 is consecutively lighted, thereby causing a so-called overshoot.

To eliminate such a problem, Japanese Publication for Unexamined Patent Application No. 3-10275/1991 proposes the following arrangement. According to the arrangement, the rotation, stoppage, and rotation speed of a heat fixing roller is controlled in accordance with fuzzy rules using input values, such as the surface temperature of the heat fixing roller, ambient temperature, and cumulative elapsed time since the power supply is turned on.

Other conventional arrangements are proposed by Japanese Publication for Unexamined Patent Applications No. 4-73786/1992 and No. 4-303875/1992. According to the arrangements, a heater is controlled in accordance with fuzzy rules using the temperature of a heat fixing roller and its temperature change. A still another conventional arrangement is proposed by Japanese Publication for Unexamined Patent Application No. 4-178678/1992. According to the arrangement, the on/off action of a heater is fuzzy-controlled in accordance with the temperature of a heat fixing roller and its differential values. Still a further conventional arrangement is proposed by Japanese Publication for Unexamined Patent Application No. 5-323830/1993. According to the arrangement, the on/off action of a heater is fuzzy-controlled based on a deviation of room temperatures, a thermistor output, and its gradient.

According to each of the foregoing conventional arrangements, however, a correct fuzzy rule should be prepared in advance. In other words, if the prepared fuzzy rule is incorrect, the heater is not controlled in a proper manner. Further, a membership function representing a fuzzy variable is not revokable once specified. Therefore, the correct membership function must be found in advance by trial and error, thereby causing that it is troublesome to prepare fuzzy rule.

Moreover, since the fuzzy rules and membership function are not changeable once prepared, the foregoing arrangements can not comply with the difference in the models and individuals, deterioration with age, and changes in environments.

SUMMARY OF THE INVENTION

It is an object of the present invention to provide a heater control device which consecutively learns the differences in such as deterioration with age and environments to find an optimal on/off period of a heater without overshoot.

To achieve the above object, the heater control device of the present invention comprises, for example:

(1) a temperature detecting circuit for detecting a surface temperature (actual surface temperature) of a heat radiating unit such as a heating roller provided in a heat fixing device, (2) a temperature change outputting circuit for outputting a temperature change, which is caused by the heat radiating unit, during a predetermined period of time, (3) a heater on-time computing and controlling circuit, provided with a first fuzzy neural network, for computing and controlling the heater on-time of the heater in accordance with the outputs of the temperature detecting circuit and the temperature change outputting circuit, (4) a predicting circuit for predicting a surface temperature (predicted surface temperature) of the heat radiating unit during next detecting time of the surface temperature by a second fuzzy neural network, in accordance with the result of detection by the temperature detecting circuit, the output from the temperature change outputting circuit, and the output from the heater on-time computing and controlling circuit, (5) a judging circuit for judging, at least based on the predicted surface temperature and the actual surface temperature, whether or not the first and the second fuzzy neural networks should carry out the learning, and (6) a target value setting circuit for setting target values which are used as teaching data in adjusting weights of respective links of the first and the second fuzzy neural networks, when the judging circuit judges to carry out the learning.

With the above structure, the heater on-time computing and controlling circuit computes and controls the heater on-time in accordance with an actual surface temperature and a temperature change by use of the first fuzzy neural network. The predicting circuit predicts a surface temperature of the heat radiating unit during the next detecting time of the surface temperature, in accordance with an actual surface temperature, a temperature change, and a heater on-time, by use of the second fuzzy neural network. The judging circuit compares at least a predicted surface temperature and an actual surface temperature, so as to decide whether or not the first and the second fuzzy neural networks should perform the learning, and in case the learning is performed, the target value setting circuit sets target values for the first and the second fuzzy neural networks.

Therefore, if only parameters are set roughly when a heater control device is manufactured, the first and the second fuzzy neural networks are adjusted by sequential learning, so that they output optimal values. In addition, with the second fuzzy neural network, the predicting circuit non-linearly computes the predictive surface temperature, whereby more accurate prediction is possible in comparison with the computation, for example, using a linear approximation.

As a result, the programming in manufacturing the heater control device is simplified. The heater control device promptly changes the heater on-time in response to the temperature change, complying with differences in such as models and individuals, deterioration with age, and changes in environments. Therefore, abnormal temperatures of the heat radiating unit, such as overshoot, can be prevented.

In addition, the judging circuit compares the three temperatures of the heat radiating unit, that is, the determined upper limit temperature, the actual surface temperature, and the predicted surface temperature. The judging circuit sends a control signal to the target value setting circuit so that the first and the second target values are set, when the three temperatures satisfies one of following relations, upper limit temp.>predicted temp.>actual temp., predicted temp.>actual temp.>upper limit temp., actual temp.>predicted temp.>upper limit temp., and actual temp.>upper limit temp.>predicted temp.

With such an arrangement, the first and the second fuzzy neural networks perform the learning only when the three temperatures are in such relations as mentioned above, that is, relations which lead to overshoot or undershoot.

Therefore, because the learning by the first and the second fuzzy neural networks is not required in all the cases in which the actual temperature and the predicted temperature differ, the time for learning is saved by performing the learning only in necessary cases. Thus, the overshoot and undershoot are prevented in an effective manner.

Further, it is preferable that the target value setting circuit sets the predicted temperature as the second target value, when the three temperatures of the heat radiating unit, namely, the upper limit temperature, the actual surface temperature, and the predicted surface temperature, satisfies one of following relations, upper limit temp.>predicted temp.>actual temp., and actual temp.>upper limit temp.>predicted temp.

With the arrangement, the second fuzzy neural network has the predicted temperature as the target value, namely, a teaching data, with which the weights are adjusted. And, the heater on-time which is computed based on the above teaching data is made a teaching data for the first fuzzy neural network. Therefore, even if the actual temperature of the heat radiating unit exceeds the upper limit temperature, it is possible to obtain an optimal on-time of the heater without abnormal temperatures of the heat radiating unit, such as overshoot.

Besides, it is preferable that the target value setting circuit sets the upper limit temperature as the second target value, when the three temperatures of the heat radiating unit, namely, the determined upper limit temperature, the actual surface temperature, and the predicted surface temperature, satisfies one of following relations, predicted temp.>actual temp.>upper limit temp., and actual temp.>predicted temp.>upper limit temp.

With the arrangement, the second fuzzy neural network has the upper limit temperature as the target value, namely, a teaching data, to adjust the weights. And, the heater on-time which is computed based on the above-mentioned teaching data is in turn made a teaching data for the first fuzzy neural network. Therefore, since the actual surface temperature of the heat radiating unit never exceeds the upper limit temperature, it is possible to obtain an optimal heater on-time without abnormal temperatures of the heat radiating unit, such as overshoot.

Further preferably, the heater control device is provided with a memory unit which records at least one and at most 10 sets of the latest learning data, and the first and the second fuzzy neural networks use the learning data during the learning. Such an arrangement enhances the accuracy of the heater control device in controlling the heater on-time, because the past learning data are also learned by the first and the second fuzzy neural networks. Moreover, the memory size of the memory unit can be reduced and the time required for the learning can be decreased, because the amount of data to be learned is small.

For a fuller understanding of the nature and advantages of the invention, reference should be made to the ensuing detailed description taken in conjunction with the accompanying drawings.

DESCRIPTION OF THE EMBODIMENTS

The following description describes an example embodiment of the present invention by reference to FIGS. 1 through 9. The present description explains a heat fixing device as a heater control device, which is provided in an electrophotographic image forming apparatus, to heat-fuse a toner image transferred onto a recording paper.

Figure 1:
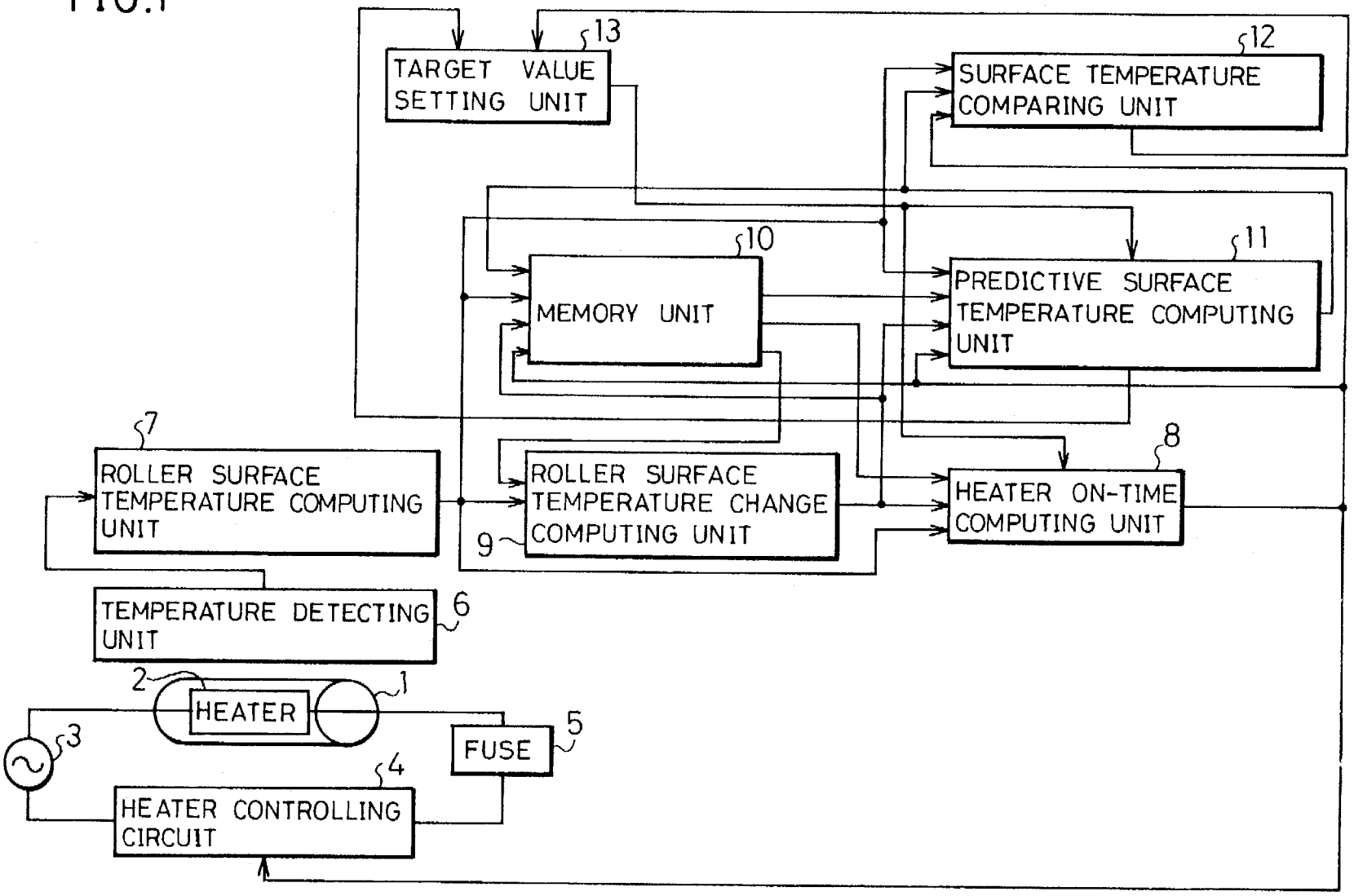
FIG. 1 is a block diagram depicting an electrical structure of a heat fixing device in accordance with an example embodiment of the present invention.

The heat fixing device of this embodiment of the present invention, as shown in FIG. 1, includes a heat fixing roller 1 as a heat radiation means to heat-fuse a toner image transferred onto a recording paper. In the inside, the heat fixing roller 1 has a heater 2 comprised of a halogen lamp and other items. Accordingly, by heat of the heater 2 transmitting from the inside of the heat fixing roller 1 to the surface thereof, the surface thereof is heated, thereby melting toner on a piece of paper which touches the heat fixing roller 1. But, the heat fixing roller 1 conducts the heat generated by the heater 2 to its surface after a thermal response time. In other words, the surface temperature of the heat fixing roller 1 starts or stops to rise a few seconds after the heater 2 is turned on or off because of the thermal response time.

As the heater 2 is connected to an AC power source 3 a thermal fuse 5 and a heater controlling circuit 4, power is supplied from the AC power source 3 to the heater 2 through the heater controlling circuit 4 and the thermal fuse 5.

The heater controlling circuit 4 is composed of relays, IC switches and other components, to supply the heater 2 with power. The heater controlling circuit 4 starts or stops power to the heater 2 in response to a driving signal including an on/off command from a heater on-time computing unit 8, which will be described below. The heater controlling circuit 4 outputs to a surface temperature computing unit 7, which also will be described below, a state display signal, which shows an on/off state in response to the driving signal. The heater controlling circuit 4 and the heater on-time computing unit 8 compose heater on-time computing and controlling means.

A temperature detecting unit 6, which is in effect a thermistor or the like, is provided in the vicinity of the heat fixing roller 1. The resistance across terminals of the temperature detecting unit 6 varies in response to a change in the surface temperature of the heat fixing roller 1. The surface temperature computing unit 7 is provided in association with the temperature detecting unit 6. The temperature detecting unit 6 and the surface temperature computing unit 7 compose temperature detecting means.

Figure 2:
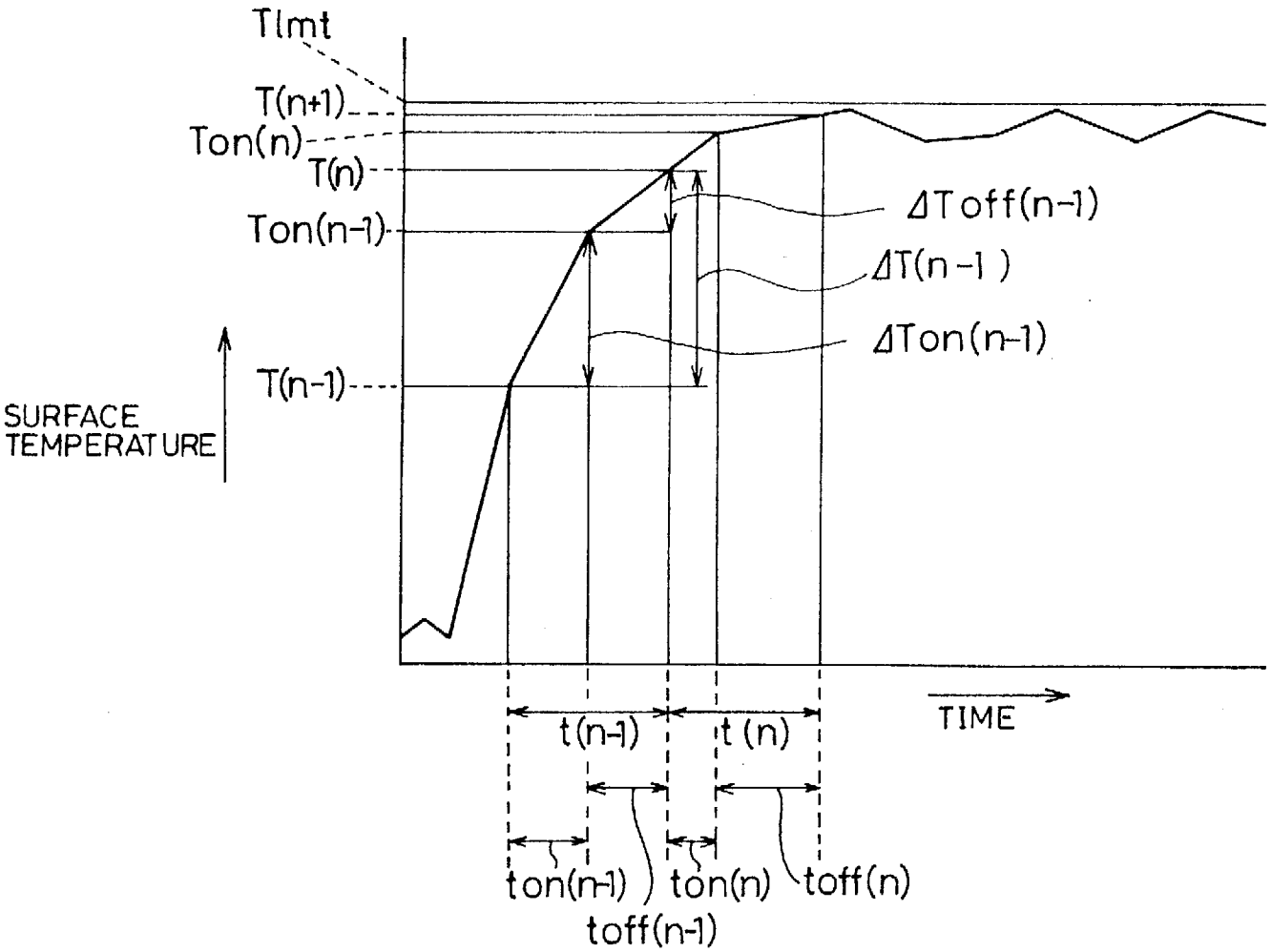
FIG. 2 is a graph showing an example of a sampling timing of the surface temperature of a heat fixing roller and a sampled temperature.

The roller surface temperature computing unit 7 carries out the sampling of the roller surface temperature in response to the state display signal which is outputted from the heater controlling circuit 4 at a predetermined period t(h) (h=1, 2, . . . , n−1, n, n+1, n+2, . . . ), for example, at a period of 3 to 5 seconds (see FIG. 2). More specifically, each sampling is carried out, in accordance with the timing when the heater 2 is turned on and off, by converting into a digital signal the terminal voltage which corresponds to the resistance across terminals of the temperature detecting unit 6. Then, the roller surface temperature computing unit 7 computes a surface temperature corresponding to the sampled voltage value with reference to a voltage-temperature conversion table, which is prepared in advance.

In FIG. 2, ton(h) represents a period of time (on-time) during which the heater 2 is turned on within the h'th period t(h), while toff(h) represents a period of time (off-time) during which the heater 2 is turned off in the h'th period t(h). Also, T(h) represents the surface temperature of the heat fixing roller 1 at the start of the period t(h), while Ton(h) represents the surface temperature of the heat fixing roller 1 at the end of the on-time period t(h). Further, ΔTon(h) represents the temperature change during the on-time during the h'th period t(h), and ΔToff(h) represents the temperature change during the off-time during the h'th period t(h). ΔT(h) represents the temperature change during the h'th period t(h). In addition, Tlmt represents the upper limit of temperature of the heat fixing roller 1, which represents at the same time the target temperature.

The surface temperature of the heat fixing roller 1 thus found by the roller surface temperature computing unit 7 is sent to a heater on-time computing unit 8, a surface-temperature change computing unit (temperature change outputting means) 9, a memory unit 10, a predictive surface temperature computing unit (predicting means) 11, and a surface temperature comparing unit (judging means) 12, as shown in FIG. 1.

Note that the memory unit is composed of memory means including RAM, and records outputs of computation by the heating period computing unit 8, the roller surface temperature change computing unit 9, and a predictive surface temperature computing unit 11, as well as the output of the computation by the roller surface temperature computing unit 7.

Using the preceding surface temperature inputted and stored in the memory unit 10, for example, the preceding input surface temperature T(n−1) and the present input surface temperature T(n), the roller surface temperature change computing unit 9 computes a temperature change ΔT(n−1) within the preceding period t(n−1). The temperature change ΔT(n−1) can be found using Equation (1) below.

$$\Delta T(n-1)=T(n)-T(n-1) \tag{1}$$

The surface temperature T(n) and the temperature change ΔT(n−1) thus found are used as input parameters by the heater on-time computing unit 8, which computes an on-time of the heater 2 ton(n), using the first fuzzy neural network 21 (see FIG. 3), which will be described below. Then, the heater on-time computing unit 8 outputs a driving signal to the heater controlling circuit 4, so as to turn on the heater 2 since the beginning of the current period t(n) for the demanded duration of on-time period ton(n) thus found.

The on-time ton(n) has been sent to the predictive surface temperature computing unit 11, which predicts, using the second fuzzy neural network 22 (see FIG. 8), a surface temperature T(n+1) to be detected in the following period. During such prediction, the on-time ton(n) and the temperature change ΔT(n−1) as well as the surface temperature T(n) are used as input parameters. The predictive surface temperature computing unit 11 sends the result of the prediction to the surface temperature comparing unit 12 and the memory unit 10. Note that hereinafter the surface temperature (predicted surface temperature) predicted by the predictive surface temperature computing unit 11 is represented as T'(n), so as to be distinguished from the actual surface temperature (actual surface temperature T(n)) computed by the surface temperature computed unit 7.

When the surface temperature is predicted to exceed the upper limit temperature, the predicted surface temperature computing unit 11 outputs a control signal to the heater on-time computing unit 8 through the roller surface temperature comparing unit 12 and the target value setting unit 13. The first fuzzy neural network 21 in the heater on-time computing unit 8 is fine-adjusted in accordance with the control signal.

In response to the control signal, the heater on-time computing unit 8 first performs fine adjustment, which will be depicted later. Then, with the actual surface temperature T(n+1) and temperature change ΔTon(n) during the n+1'th period t(n+1), the computing unit 8 computes the on-time ton(n+1) during the n+1'th period.

The roller surface temperature comparing unit 12 compares the predicted surface temperature T'(n+1) during the n+1'th period t(n+1), the actual surface temperature T(n+1) computed by the surface temperature computing unit 7, and the predetermined upper limit temperature (upper limit surface temperature). Exclusively when the relations among the above three temperatures are identical with specific relations which will be depicted below, the comparing unit 12 outputs a control signal to fine-adjust the first fuzzy neural network 21 provided with the on-time computing unit 8 as well as the second fuzzy neural network 22 provided with the predicted surface temperature computing unit 11.

Responding to the control signal through the target value setting unit 13, the heater on-time computing unit 8 first makes fine adjustment as mentioned later, then computes an on-time ton(n+1) within the n+1'th period t(n+1), using the actual surface temperature T(n+1) and the temperature change ΔT(n), which are found during the n+1'th period t(n+1). Also in response to the control signal, the predictive surface temperature computing unit 11 first makes fine adjustment as described later, then predicts a surface temperature T'(n+2) to be detected at the following detecting time, using the on-time ton(n+1), which the heater on-time computing unit 8 computed as mentioned above, the temperature change ΔT(n), and the surface temperature T(n+1).

The target value setting unit 13 is arranged so that (1) when the roller surface temperature comparing unit 12 judges that adjustment of weights of the first and the second fuzzy neural networks 21 and 22 is necessary, the target value setting unit 13 fixes target values as teaching data, which are to be used in adjusting the respective weights, and (2) when the temperatures satisfy one of the relations of temperatures which will be described later, the target value setting unit 13 gives the target value to the heater on-time computing unit 8 and the predictive surface temperature computing unit 11.

The fine adjustment is conducted under the following relations of temperatures. Note that the upper limit of the surface temperature of the heat fixing roller 1 is represented as UPPER LIMIT TEMP. (upper limit surface temperature), a predicted value of the surface temperature of the heat fixing roller 1 as PREDICTED TEMP. (predicted surface temperature), and an actual value of surface temperature of the heat fixing roller 1 as ACTUAL TEMP. (actual surface temperature).

The relations of the three temperatures mentioned above are:

UPPER LIMIT TEMP.>PREDICTED TEMP.>ACTUAL TEMP.

PREDICTED TEMP.>ACTUAL TEMP.>UPPER LIMIT TEMP.

ACTUAL TEMP.>PREDICTED TEMP.>UPPER LIMIT TEMP.

ACTUAL TEMP.>UPPER LIMIT TEMP.>PREDICTED TEMP.

Figure 3:
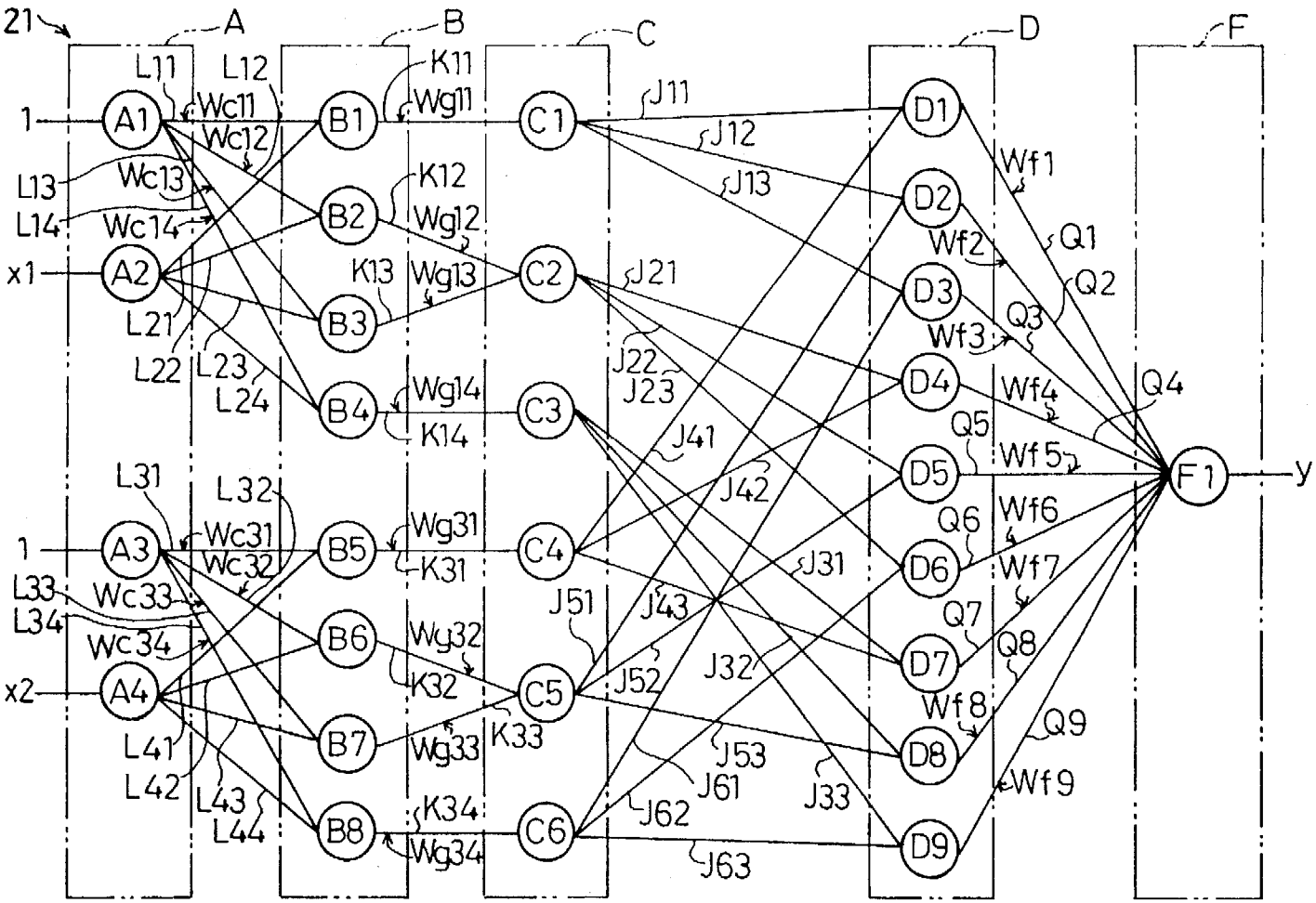
FIG. 3 is a block diagram depicting a structure of the first fuzzy neural network of the present invention, which is provided in a heater on-time computing unit of the heat fixing device.
Figure 8:
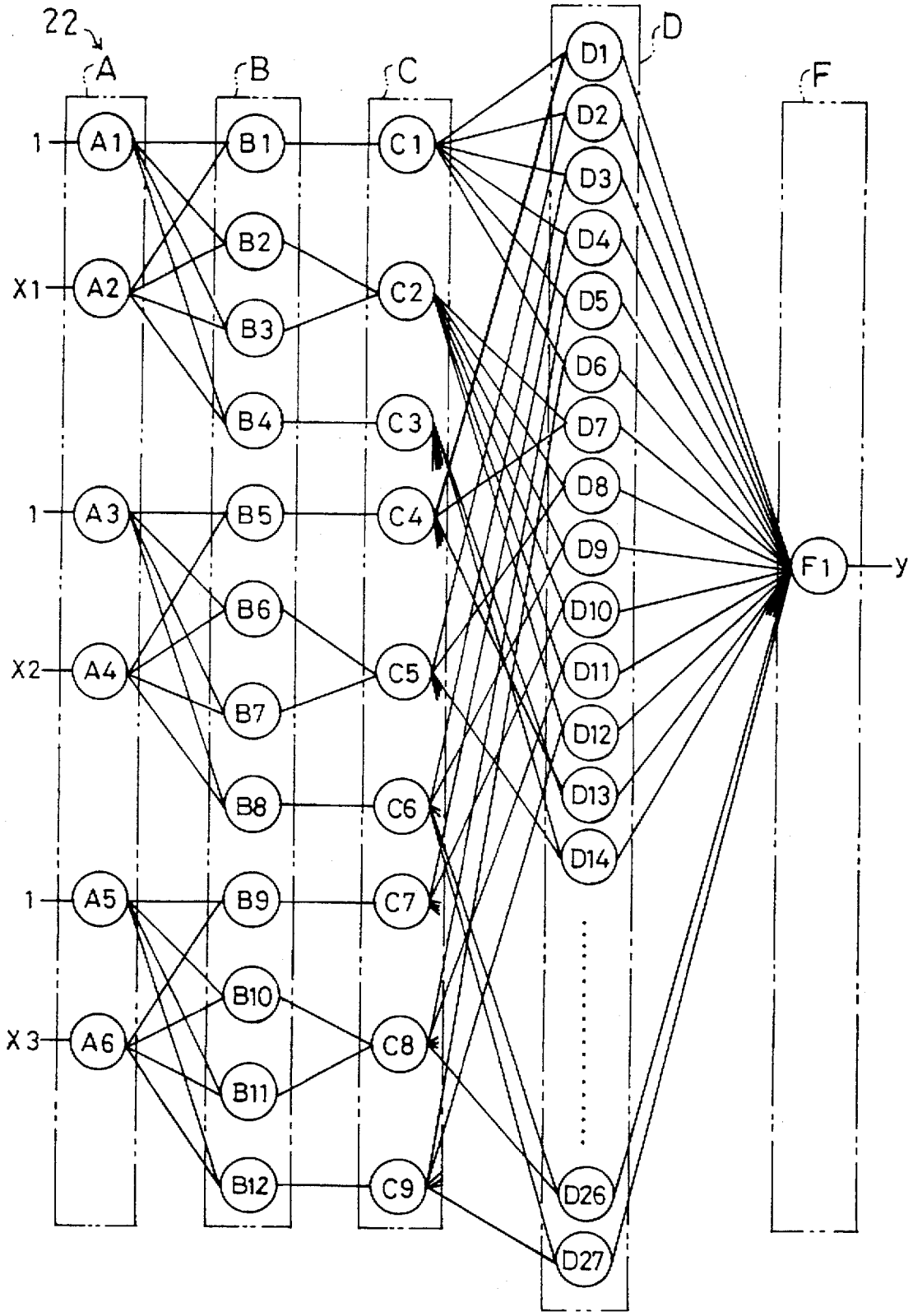
FIG. 8 is a block diagram depicting a structure of the second fuzzy neural network of the present invention, which is provided in a predictive surface temperature computing unit of the heat fixing device.

The following description deals in the first fuzzy neural network 21 provided with the heater on-time computing unit 8 and the second fuzzy neural network 22 provided in the predictive surface temperature computing unit 11, by reference to FIGS. 3 and 8.

The first fuzzy neural network 21 is assembled in substantially the same manner as that of Japanese Patent Application No. 6-175805/1994 by Applicant of the present invention, and the detailed explanation was made in the application. The second fuzzy neural network 22 also has substantially the same fundamental structure and basic method of arithmetic operation, only with the different number of items of input data. Therefore, this description focuses mainly on the first fuzzy neural network 21.

In the present embodiment, as shown in FIG. 3, the fuzzy neural network 21 has two input values x1 and x2, x1 indicating the surface temperature T and x2 indicating the surface temperature change ΔT, while it outputs y to the heater controlling circuit 4. The first fuzzy neural network 21 is composed of an input layer A, a membership input layer B, a membership output layer C, a rule layer D, and an output layer F.

The input layer A includes: (1) a node A2 into which the input value x1 (the surface temperature T) is inputted, (2) a node A1 into which a constant number, i.e., one, related to the surface temperature T is inputted, (3) a node A4 into which the input value x2, namely, the temperature change ΔT, is inputted, and (4) a node A3 into which a constant number, i.e., one, related to the temperature change ΔT is inputted.

Figure 4:
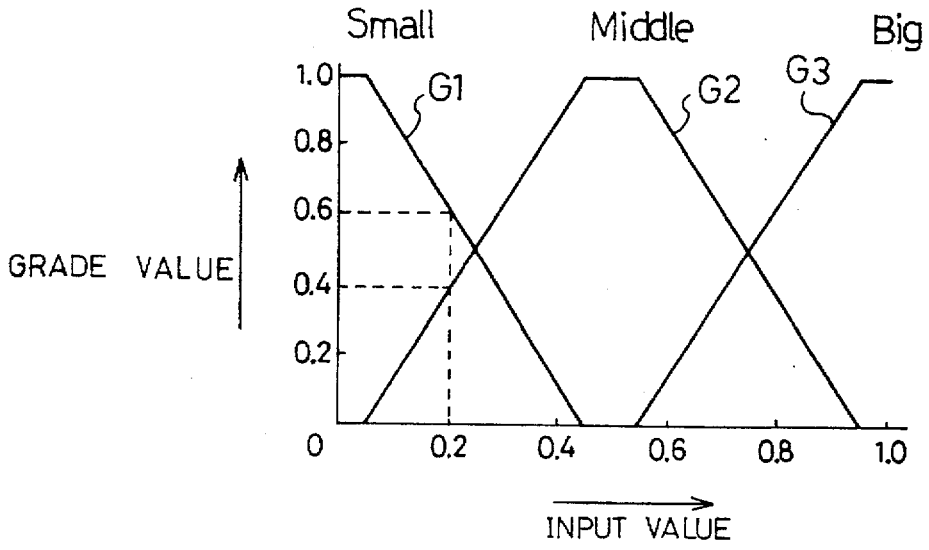
FIG. 4 is a graph showing a membership function used in the present invention.

The membership function with the respective input data x1, 1; x2, 1, as shown in FIG. 4, is divided into three areas: an area Small denoted as G1, an area Middle denoted as G2, and an area Big denoted as G3. In FIG. 4, the horizontal axis represents an input value x1 or x2, while the vertical axis represents a grade value of the membership function. For instance, let x1 be 0.2, then the grade values indicating the probability of fuzzy propositions, "x1 is small", "x1 is middle", and "x1 is big" are respectively 0.6, 0.4, and 0.0, as shown in FIG. 4. The grade value of a fuzzy proposition falls within a range between 0 and 1 inclusive.

The membership input layer B of the present embodiment includes nodes B1–B4;B5–B8 respectively for the input values x1 and x2, and hence the nodes A1, A2;A3, A4 in the input layer A, respectively. Of all the areas of the membership function shown in FIG. 4, the Small area denoted as G1 and the Big area denoted as G3 are respectively monotonous decreasing and monotonous increasing, and each uses a single node. Whereas the Middle area denoted as G2 is a chevron type, and thus uses two nodes, and is expressed by an AND of a sigmoid function of the nodes.

Figure 5:
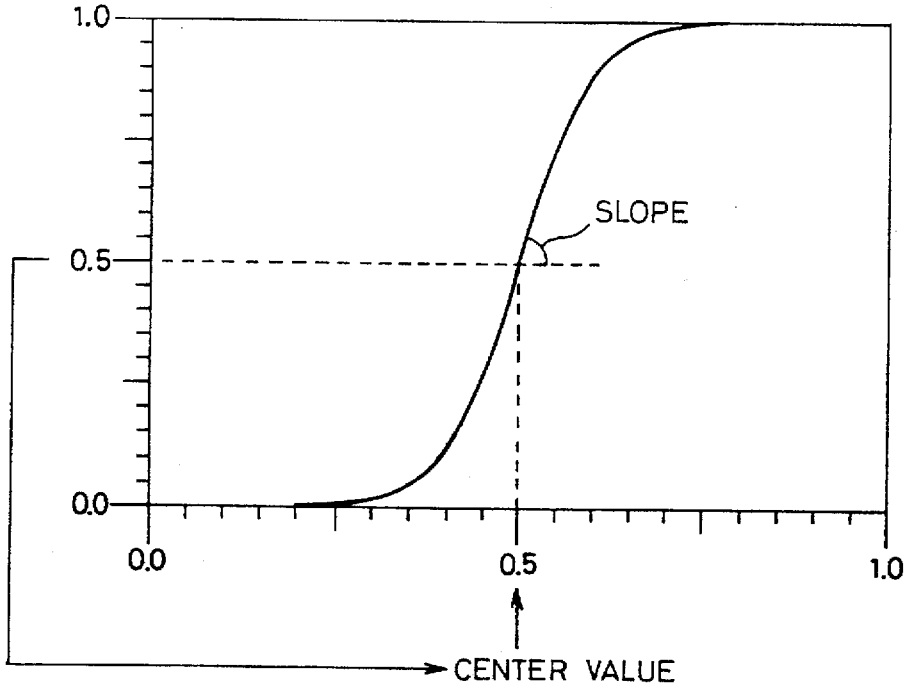
FIG. 5 is a graph explaining the relation between the membership function and weights Wcij and Wgij.

The nodes A1, A2 and B1–B4 are respectively connected to each other by links Lij (i=1, 2, j=1, 2, 3, 4), and so are the nodes A3, A4 and B5–B8 by links Lij (i=3, 4, j=1, 2, 3, 4). Each of the links L11–L14 and L31–L34 have their respective weights Wcij (i=1, 3, j=1–4) representing a center value of the membership function. Whereas a weight of one is given to the other links L21–L24 and L41–L44. The weight Wcij is an input value when the grade value of the membership function becomes the center value. For example, in case the membership function is a monotonous increasing function as shown in FIG. 5, the input value is 0.5 when the grade value becomes the center value (0.5), thus, the weight Wcij is 0.5.

Thus, the weight Wc11 is the center value of the membership function that indicates the input value x1 is Big, while the weight Wc14 is the center value of the membership function that indicates the input value x1 is Small. The membership function that indicates the input value x1 is Middle is expressed by an AND of two membership functions, therefore the weights Wc12 and Wc13 are the center values.

Wcij is a value of an input value x1 (x2) when an output value from A1 (A3) is 0.5, therefore an input value Hij to the membership input layer B is the adding result of the input value xi and the weight Wcij.

$$Hij=xi+Wcij \tag{2}$$

In an equation used in a neural network computation, the output of each layer is expressed as f{Σ(input to each layer x weight of a link)}, therefore the right-hand side of the equation(2) is xi×1+1×Wcij. As previously explained, the weights of the links L21–L24 and L41–L44 respectively provided for the input values x1 and x2 are set to one. The links L11–L14 and L31–L34 provided for the constant number one have the weights Wc11–Wc14 and Wc31–Wc34, respectively.

Next, the membership output layer C includes six nodes corresponding to the three areas G1–G3 of the fuzzy propositions: nodes C1–C3; C4–C6 for the input values X1 and X2, respectively. The membership input layer B and membership output layer C are connected to each other by links Kij (i=1, 3, j=1–4). An input value Hij of the membership input layer B is multiplied by the weight Wgij representing a slope of the membership function and outputted to the membership output layer C. Using the above resulting value as an input value to the sigmoid function, an output value of the sigmoid function Mik is found.

$$Mik=f(Hij\times Wgij) \tag{3}$$

Figure 6:
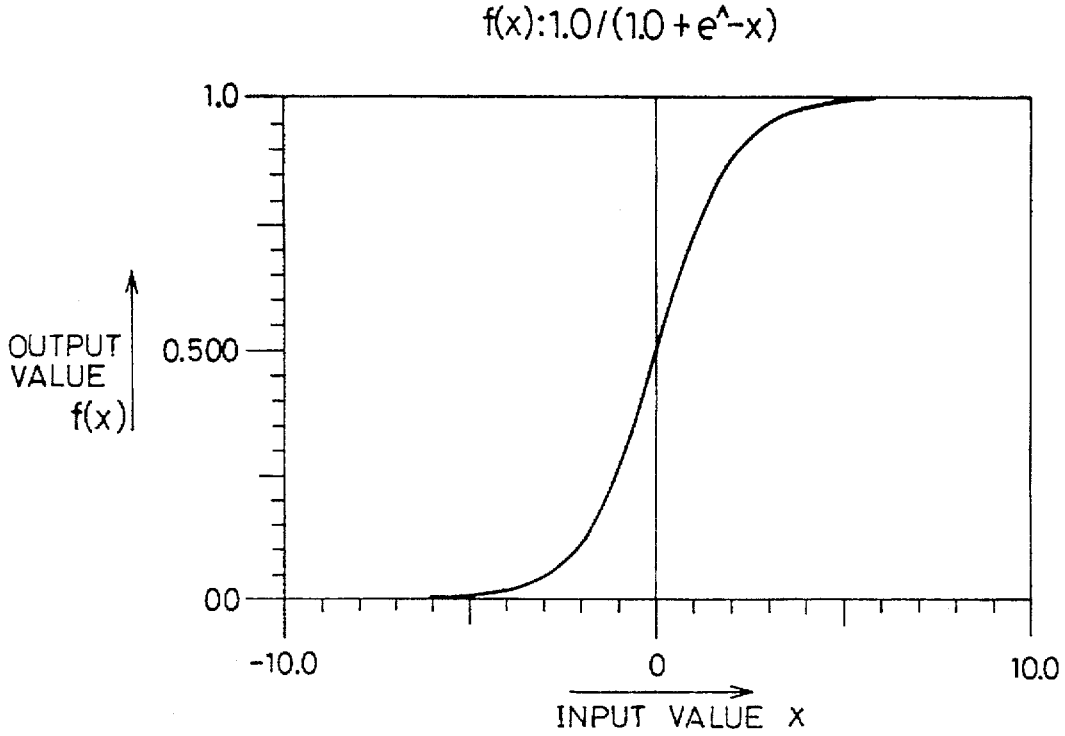
FIG. 6 is a graph showing a sigmoid function.

As shown in FIG. 5, the weight Wgij represents a slope of the membership function when the input value Hij is the center value. Further, as shown in FIG. 6, the sigmoid function referred hereinbefore is a non-linear function whose input value x is in a range between $-\infty$ and $+\infty$ and whose output value f(x) is in a range $0.0 < f(x) < 1.0$, as expressed by Equation (4) below.

$$f(X)=\frac{1}{1+\exp(-X)} \tag{4}$$

Within the Middle area G2, the AND of the two sigmoid functions must be computed. To be more specific, the computation result of the input value x1 of FIG. 3 through the node B2 to the node C2 and the computation result of the input value x1 from the node B3 to the node C2 are compared, and whichever smaller is selected as the output value from the node C2 corresponding to the Middle area G2. Likewise, the computation result of the input value x2 from the node B6 to the node C5 and the computation result of the input value x2 from the node B7 to the node C5 are compared, and whichever smaller is selected.

Thus, the nodes B1–B8 are connected, in the following manner, to the nodes C1, C2, C3; C4, C5, C6 in the membership output layer C, which correspond to the three areas G1, G2, and G3 of the membership function. The nodes B1, B4; B5, B8 are respectively connected to the nodes C1, C3; C4, C6 by the links K11, K14; K31, K34 each having their respective weights Wg11, Wg14; Wg31, Wg34. The nodes B2 and B3 are respectively connected to the node C2 by the links K12 and K13 having their respective weights Wg12 and Wg13. Further, the nodes B6 and B7 are respectively connected to the node C5 by the links K32 and K33 having their respective weights Wg32 and Wg33.

The rule layer D includes nine nodes D1–D9 to correspond to any possible link of the node C1–C3 and C4–C6 in the membership layer C which correspond to the three areas G1–G3 for the input values x1 and x2, respectively.

The nodes C1, C2, and C3 are connected to the nodes D1–D3; D4–D6; D7–D9 by links J11–J13; J21–J23; J31–J33, respectively. On the other hand, the nodes C4, C5, C6 are connected to the nodes D1, D4, D7; D2, D5, D8; D3, D6, D9 by links J41–J43; J51–J53; J61–J63, respectively. Note that a weight of one is given to each of the links J11–J13; J21–J23; J31–J33; J41–J43; J51–J53; J61–J63.

Thus, two inputs are given to each of the nodes D1–D9. Each of the nodes D1–D9 selects the smaller of the two inputs Mi1k1 and Mi2k2, as expressed by Equation (5) below, whereby Rp(p=1, 2, . . . , 9) is outputted.

$$Rp=min\{Mi1k1,\ Mi2k2\} \tag{5}$$

The output value Rp of each of the nodes D1–D9 in the rule layer D is sent to a node F1 in the output layer F through links Q1–Q9 having their respective weights of Wf1–Wf9 which are determined in advance using the knowledge obtained from experts. At the node F1, the output values Rp are added and outputted, which is expressed as Equation (6) below:

$$y=\frac{\sum_p Rp\times Wfp}{\sum_p Rp} \tag{6}$$

Thus, a weighted mean of the output values Rp from the nodes D1–D9 is computed in accordance with the weights Wf1Wf9 of the respective links Q1–Q9 to determine the heater on-time, and it is the output value y, namely, the on-time ton.

Figure 7:
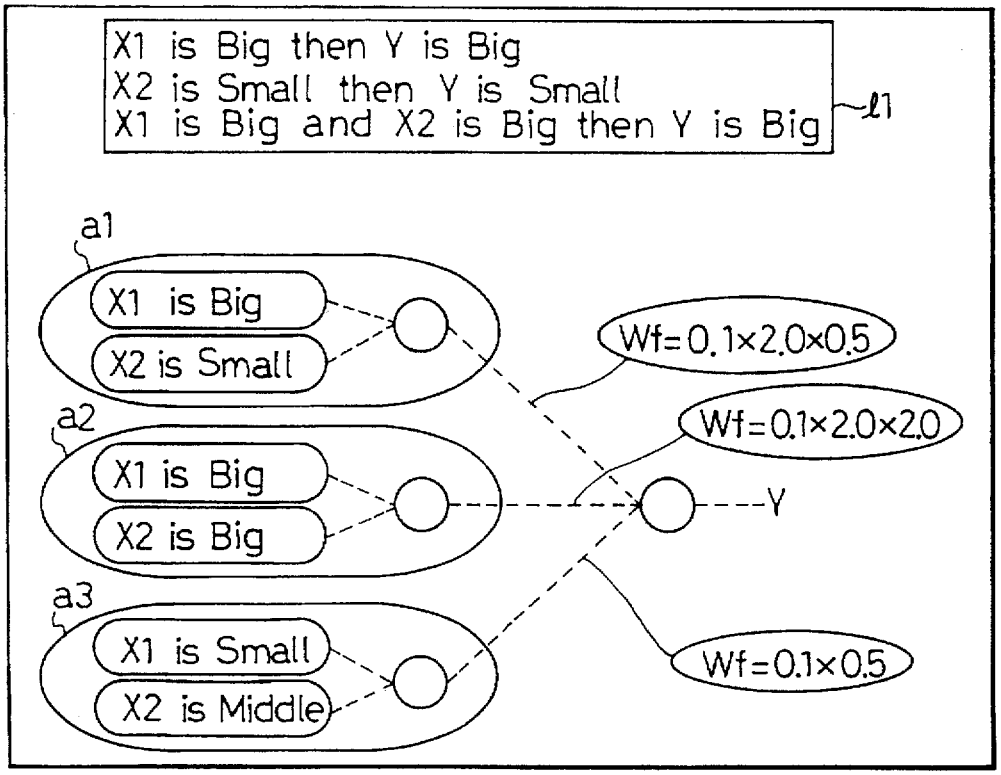
FIG. 7 is a diagram explaining how to determine the weight of each rule among networks.

Next, how each weight is determined will be explained by reference to FIG. 7. To begin with, a rule l1 is prepared using the knowledge obtained from the learning of experts. Herein, rule l1 comprises, "x1 is Big then y is Big.", "x2 is Small then Y is Small.", and "x1 is Big and x2 is Big then y is Big." Next, AND rules a1–a3 are generated in the rule layer D, and an initial value of a weight is determined by comparing links between the nodes of the expert rule l1 and those of the AND rules a1–a3 in the rule layer D.

The initial value of each rule is set to a reference value, for example, 0.1. Next, a weight of a link to the output layer F from an AND rule is multiplied with the number of input items of the network, if the AND rule fits a rule in the rule l1 of experts that "an output value y increases". In contrast, a weight of a link to the output layer F from an AND rule is multiplied with the reciprocal of the number of the input items of the network, if the AND rule fits a rule in the rule l1 of experts that "an output value y decreases".

For example, according to the rule obtained from the knowledge of experts, the input value x1 is Big in the AND rule a1, whereby an output value y is Big, thus the initial value of the weight, 0.1, is multiplied by the number of the input values, i.e., two. Further, in accordance with the rule obtained from the knowledge of experts, the input value x2 is made Small, whereby an output value y is Small, thus the initial value of the weight, 0.1, is multiplied by the reciprocal of the number of the input values, 0.5. Accordingly, the initial value of the weight of the AND rule a1 is determined as $0.1\times2\times0.5=0.1$. Similarly, the weight of the AND rule a2 is determined as $0.1\times2\times2=0.4$, and the weight of the AND rule a3 is determined as $0.1\times0.5=0.05$. The values thus obtained are the initial values of the weights of these rules a1–a3 before the learning, respectively.

In the initial stage of the network assembly, each weight is determined in advance using the knowledge obtained from the experts as explained in the above. However, these weights may not be appropriate for the input values x1 and x2 in some cases. Therefore, the first fuzzy neural network 21 of the present invention adjusts the weights in a manner depicted below at real time using the knowledge obtained from the learning algorithm while controlling the heater 2. The learning algorithm based on the backpropagation used in the present invention is common in the neural network.

When the control signal is outputted from the surface temperature comparing unit 12 to the heater on-time computing unit 8, the heater on-time computing unit 8 sends the roller surface temperature T and the temperature change ΔT, which were used in comparing, to the target value setting unit 13. At the same time, the surface temperature comparing unit 12 also sends a target temperature which will be described below (hereinafter, it is referred to as teaching data Ot2, of the second fuzzy neural network 22 in the predictive surface temperature computing unit 11) to the target value setting unit 13. Then, the target value setting unit 13 computes a heater on-time in accordance with Equation (7) below, using the teaching data Ot2, ther roller surface temperature T, the temperature change ΔT, and the period t. The result of computation is sent to the heater on-time computing unit 8, as an output target value (hereinafter, teaching data Ot1, of the first fuzzy neural network 21 of the heater on-time computing unit 8). In addition, under a desired condition, the target value setting unit 13 sends the predictive surface temperature computing unit 11 the teaching data Ot2 sent from the surface temperature comparing unit 12, as a target value for the second fuzzy neural network 22.

$$Ot_1 = \frac{Ot_2 - T - \Delta Toff \cdot t}{\Delta Ton - \Delta Toff} \tag{7}$$

The following description is about some of the relations between the three temperatures related to the heat fixing roller 1, which are used for the comparison by the surface temperature comparing unit 12. When the three temperatures satisfy one of the relations described below, the setting of the teaching data Ot2 is conducted. Note that the upper limit temperature of the heat fixing roller 1 is represented as UPPER LIMIT TEMP. (upper limit surface temperature), a predicted value of the surface temperature of the heat fixing roller 1 as PREDICTED TEMP. (predicted surface temperature), and an actual value of surface temperature of the heat fixing roller 1 as ACTUAL TEMP. (actual surface temperature).

When the three temperatures satisfy either UPPER LIMIT TEMP.>PREDICTED TEMP.>ACTUAL TEMP. or ACTUAL TEMP.>UPPER LIMIT TEMP.>PREDICTED TEMP., the target temperature, or the teaching data Ot2, is set to the predicted temperature of the heat fixing roller 1. On the other hand, when the three temperatures satisfy either PREDICTED TEMP.>ACTUAL TEMP.>UPPER LIMIT TEMP., or ACTUAL TEMP.>PREDICTED TEMP.>UPPER LIMIT TEMP., the target temperature Ot2 is set to the upper limit temperature of the heat fixing roller 1.

The heater on-time computing unit 8 substitutes the surface temperature T and temperature change ΔT into the first fuzzy neural network 21 as the input values x1 and x2, respectively, and finds the output value y.

Then, a square error E of the output value y and the teaching data Ot1 thus found is found using Equation (8) below. The learning algorithm is performed by fine-adjusting the weights Wcij, Wgij, and Wfp to minimize the error E.

$$E = \frac{1}{2}\,(Ot_1 - y)^2 \tag{8}$$

The weights are fine-adjusted by (i) finding influence of each of the weights Wcij, Wgij, and Wfp by partial differentiation of the error function with the weights Wcij, Wgij, and Wfp, and (ii) changing each weight slightly in a direction such that reduces the output value of the error function. In other words, the error function expressed by Equation 8 is partial-differentiated by the output value y, which is expressed by Equation (9) below, and the influence of the output value y on the error function is found.

$$\frac{\partial E}{\partial y} = -(Ot_1 - y) \tag{9}$$

Equation 9 reveals that the output value y influences the error function more in the positive direction when the output value y is greater than the teaching data Ot1. Thus, to minimize the error function, the output value y must be adjusted in a direction such that reduces the influence of the output value y, that is, in the negative direction. Likewise, when the output value y influences the error function more in the negative direction, the output value y is fine-adjusted in the opposite direction, that is, in the positive direction. In other words, the value of the error can be decreased by (i) finding the influence of each of the weights Wcij, Wgij, and Wfp on the error function, and (ii) fine-adjusting each weight in a direction opposite to the influence.

More specifically, the influence of the weight Wfp on the error function is found using Equation (10) below, and the weight Wfp is corrected in a direction such that reduces the influence using Equation (11) below.

$$\frac{\partial E}{\partial Wfp} = \frac{\partial E}{\partial y}\,\frac{\partial y}{\partial Wfp} = -(Ot_1 - y)\frac{Rp}{\sum_p Rp} \tag{10}$$

$$\Delta Wfp = -\alpha\frac{\partial E}{\partial Wfp} \tag{11}$$

where α is a learning parameter used for adjusting a degree in fine-adjusting the weight Wfp.

Next, the influence of the weight Wgij on the error function is found using Equation (12) below, and the weight Wfij is corrected in a direction such that reduces the influence thereof, using Equation (13) below.

$$\begin{aligned}\frac{\partial E}{\partial Wgij} &= \frac{\partial E}{\partial y}\,\frac{\partial y}{\partial Rp}\,\frac{\partial Rp}{\partial Mik}\,\frac{\partial Mik}{\partial Wgij} \\ &= -(Ot_1 - y)\sum_m \left|\frac{Wfp - y}{\sum_p Rp}\right| Mik(1 - Mik)Hij\end{aligned} \tag{12}$$

$$\Delta Wgij = -\beta\frac{\partial E}{\partial Wgij} \tag{13}$$

where β, like the parameter α, is a learning parameter used for fine-adjusting the weight Wgij.

Further, the influence of the weight Wcij on the error function is found using Equation (14) below, and the weight Wcij is corrected in a direction such that reduces the influence thereof, using Equation (15) below.

$$\begin{aligned}\frac{\partial E}{\partial Wcij} &= \frac{\partial E}{\partial y}\,\frac{\partial y}{\partial Rp}\,\frac{\partial Rp}{\partial Mik}\,\frac{\partial Mik}{\partial Hij}\,\frac{\partial Hij}{\partial Wcij} \\ &= -(Ot_1 - y)\sum_m \left|\frac{Wfp - y}{\sum_p Rp}\right| Mik(1 - Mik)Wgij\end{aligned} \tag{14}$$

$$\Delta Wcij = -\gamma\frac{\partial E}{\partial Wcij} \tag{15}$$

where γ is a learning parameter as well. The learning parameters α, β, and γ are set, in advance based on the experiments, to specific values such that minimizes the error function when these parameters α, β, and γ are changed and prevents an excessive weight correction. For example, the relation among these parameters may be $\alpha \geqq \beta \geqq \gamma$.

Finally, the weights Wfp, Wgij, and Wcij are corrected using Equations (16), (17), and (18) below respectively with unit correcting values found using Equations (11), (13), and (15), namely, ΔWfp, ΔWgij, and ΔWcij, respectively.

$$Wfp(lt+1) = Wfp(lt) + \Delta Wfp \tag{16}$$

$$Wgij(lt+1) = Wgij(lt) + \Delta Wgij \tag{17}$$

$$Wcij(lt+1) = Wcij(lt) + \Delta Wcij \tag{18}$$

where lt represents the number of times of learning. For example, Wfp(lt+1)=Wfp(lt)+ΔWfp indicates that the current value Wfp(lt) is corrected using the unit correcting value ΔWfp, and the result of which, Wfp(lt+1), is substituted as the following value.

After the weights Wcij, Wgij, and Wfp are fine-adjusted in the above manner, the input values x1 and x2 are given again to find the error E with the teaching data Ot1. The learning ends, when the error E becomes in a predetermined range, for example, not more than ±2° C., or when the number of times of learning lt reaches a predetermined value, for example, 300.

Note that the number of times of learning it is in such a range that can be performed repetitively within a blink of time, for example, one second. Since the control of the heater 2 is suspended while the learning is performed, the learning period is set to such a blink of time. However, there will be no trouble if the number of times of learning is small, because the manufacturers have already completed the learning using the standard experimental data, and the network only has to learn not more than ten pieces of data on the detection and computation recorded in the memory unit 10. During the learning period, the temperature of the heat fixing roller 14 changes due to remaining heat or heat-dissipation. Therefore, when the learning period ends, the surface temperature T(n) and temperature change ΔTon (n−1) at that time are computed again, so that the first fuzzy neural network 21 that has just finished the learning may compute the output value y.

The output value y, found by the first fuzzy neural network 21 as have been described, is sent to the predictive surface temperature computing unit 11. In the predictive surface temperature computing unit 11, as described above, the second fuzzy neural network 22 computes a predicted surface temperature, using as input parameters (1) the output value y, i.e., teaching data Ot1, sent from the first fuzzy neural network 21, (2) the temperature change ΔT(n−1), and (3) the surface temperature T(n).

As shown in FIG. 8, the second fuzzy neural network 22 has three inputs respectively representing the surface temperature T indicated as x1, the temperature change ΔT indicated as x2, and the heater on-time ton indicated as x3, while an output from the second fuzzy neural network 22 to the surface temperature comparing unit 12 and the target value setting unit 13 has one value indicated as y. Note that x3 is a heater on-time found by the heater on-time computing unit 8.

The second fuzzy neural network 22 is provided with an input layer A, a membership input layer B, a membership output layer C, a rule layer D, and an output layer F.

More specifically, the input layer A of the second fuzzy neural network 22 includes: (1) a node A2 into which the input value x1, namely, the surface temperature T, is inputted, (2) a node A1 into which a constant number, i.e., one, related to the surface temperature T is inputted, (3) a node A4 into which the input value x2, namely, the temperature change ΔT, is inputted, (4) a node A3 into which a constant number, i.e., one, related to the temperature change ΔT is inputted, (5) a node A6 into which an input value x3, namely, the heater on-time ton, is inputted, (6) a node A5 into which a constant number, i.e., one, related to the heater on-time ton, is inputted.

The membership input layer B includes nodes B1–B4; B5–B8; B9–B12 respectively for the input values x1, x2, and x3, and hence the nodes A1, A2; A3, A4; A5, A6 in the input layer A, respectively.

The membership output layer C includes nodes C1–C3; C4–C6; C7–C9 respectively for the input values x1, x2, and x3. Regarding the nodes C1, C2, C3; C4, C5, C6; C7, C8, C9, (1)the nodes B1, B4; B5, B8; B9, B12 are connected respectively to the nodes C1, C3; C4, C6; C7, C9, (2)the nodes B2 and B3 are connected to the node C2, (3)the nodes B6, B7 are connected to the node C5, and (4)the nodes B10 and B11 are connected to the node C8.

The rule layer D includes 27 nodes D1–D27, so that either of the nodes correspondes to any possible link between two nodes of the nodes C1–C3; C4–C6; C7–C9 in the membership layer C, one of the three nodes in one group and the other of the three nodes in either of the other two groups. The nodes C1–C3; C4–C6; C7–C9 correspond to the three areas (G1–G3) in each of the three input values x1, x2 and x3, respectively.

Note that the learning performed in the second fuzzy neural network 22 is performed in the same manner as in the first fuzzy neural network 21, only with the teaching data Ot1 in the latter replaced with the teaching data Ot2 in the former. After the learning, a surface temperature in the following period is predicted.

Figure 9:
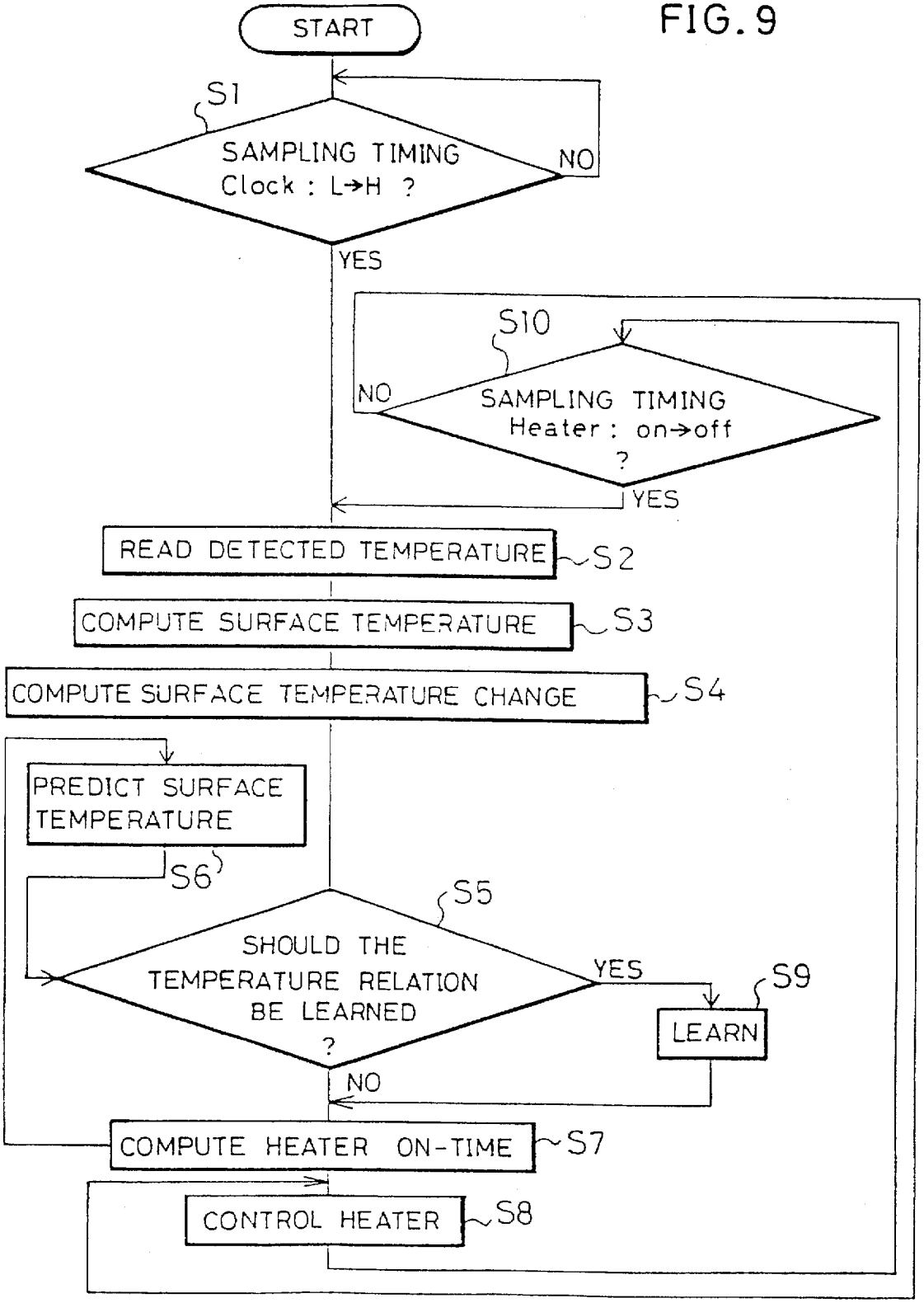
FIG. 9 is a flowchart detailing a control operation of an lighting action of a heater.
Figure 10:
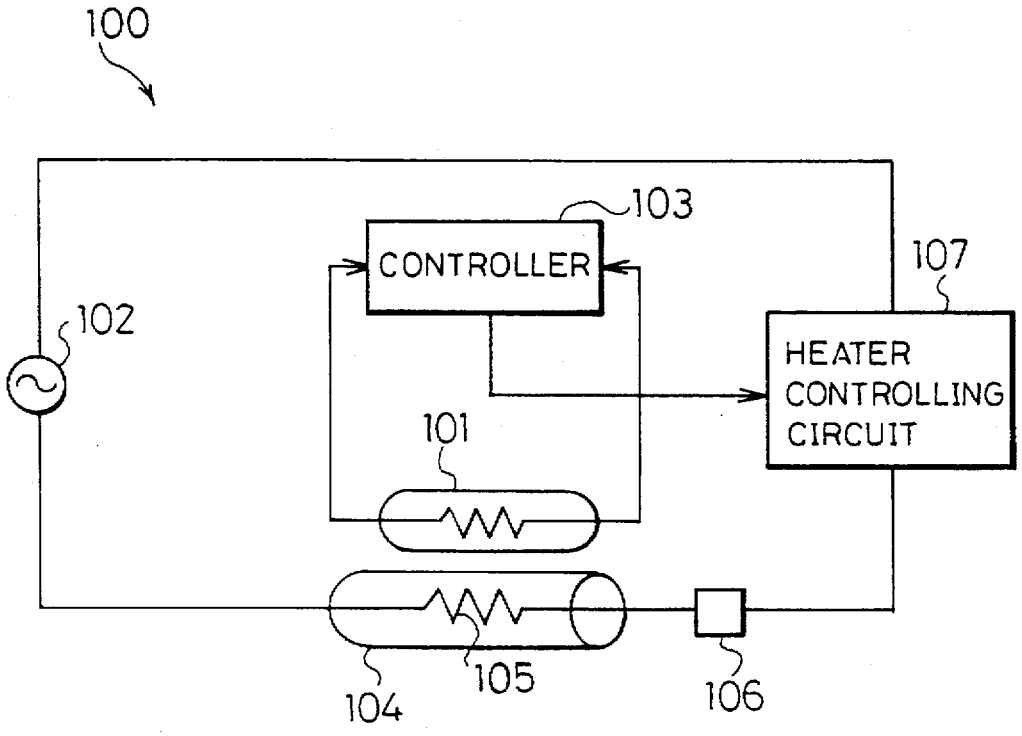
FIG. 10 is a block diagram depicting an electrical structure of a conventional heat fixing device.

The following description is about the control method of the heater 2 with reference to the flowchart in FIG. 9.

In Step 1, it is checked whether the sampling timing of the time period t(h) has come or not. Step 1 is repeated until the sampling timing comes, and when it comes, the flow proceeds to Steps 2, 3, and 4 sequentially.

In Step 2, the output voltage value of the temperature detecting unit 6 is converted into the digital form from the analogue form and sent to the surface temperature computing unit 7. In step 3, the surface temperature computing unit 7 finds the surface temperature corresponding to the voltage value with reference to the voltage-temperature conversion table. In Step 4, using the surface temperature thus found, the surface temperature change computing unit 9 computes the temperature change.

In Step 5, the surface temperature comparing unit 12 compares the surface temperature found in Step 3, the surface temperature predicted by the predictive surface temperature computing unit 11 in Step 6 which is explained below, and the predetermined upper limit temperature, to judge whether or not the relation between the three temperatures must be learned. If it is judged that the temperature relation is not to be learned, the heater on-time computing unit 8 computes the heater on-time of the heater 2 (Step 7), and controls the turning-on action of the heater 2 through the heater controlling circuit 4 (Step 8). When the heater-on time is computed in Step 7, the predictive surface temperature computing unit 11 predicts the surface temperature (Step 6), which is to be used in the following Step 5.

On the other hand, if the relation of the three temperatures is judged to be learned in Step 5, the following procedure is carried out. The surface temperature comparing unit 12 sends a control signal to the target value setting unit 13 in Step 9, and the target value setting unit 13 in turn sends a control signal to the heater on-time computing unit 8. Thereon the above-mentioned leaning is performed using the learning parameters α, β, and γ, and the flow proceeds to Step 7, where the heater on-time is computed.

After the turning-on action of the heater 2 is controlled in Step 8, the flow proceeds to Step 10. In Step 10, it is checked whether or not the on-time computed in Step 7 has passed, and if it hasn't, the flow goes back to Step 8 to keep the heater on. When the heater on-time has passed, the timing of sampling the surface temperature comes, thus the flow proceeds to Step 2, where the surface temperature when the heater is turned off, Ton(n−1), is sampled, as shown in FIG. 2.

As has been described, the heater 2 is controlled as follows: The temperature detecting unit 6 detects the surface temperature of the heat fixing roller 1, and with the result of the detection the surface temperature change computing unit 9 computes the temperature change within the predetermined period of time. Using the surface temperature and the temperature change thus found, the first fuzzy neural network 21 in the heater on-time computing unit 8 computes the heater on-time and controls the heater 2.

The data on the surface temperature of the heat fixing roller 1, the temperature change, and the heater on-time of the heater 2, which were thus detected and computed, are inputted to the second fuzzy neural network 22 of the predictive surface temperature computing unit 11, which is arranged so as to be inputted with results of detection of surface temperature, temperature change, and heater on-time. Then, based on the inputted data, the second fuzzy neural network 22 predicts the surface temperature of the heat fixing roller 1 during the following on-time under the above control. Then, the surface temperature comparing unit 12 compares the predictive temperature thus predicted, the actual surface temperature detected by the temperature detecting unit 6, and the predetermined upper limit temperature of the heat fixing roller 1. From the relation between the temperatures thus found, it is judged by the surface temperature comparing unit 12 whether or not the weights of the first and the second fuzzy neural networks 21 and 22 must be adjusted. If the weights of the first and the second fuzzy neural networks 21 and 22 are judged to be adjusted, the weights are adjusted.

Therefore, if parameters are set roughly, they are adjusted by sequential learning, whereby an optimal on-time is obtained without any overshoot. Thus, the present invention simplifies the programming, and enables easy adjustment to individual heaters depending on models, deterioration due to aging, and environments. In addition, only the surface temperature of the heat fixing roller 1 has to be detected as a parameter. Such a single input parameter simplifies the structure and reduces the computation time, thereby making it possible to promptly change the heater on-time in response to the temperature change.

Each of the input layer A and membership layers B and C of the first fuzzy neural network 21 is arranged so that an input value is divided into three areas G1, G2, and G3 of a fuzzy set, while the rule layer D is assembled with ANDs of all the possible linking rules between the three areas G1, G2, and G3 in the input value x1 and the three areas G1, G2, and G3 in the input value x2. Likewise, each of the input layer A and membership layers B and C of the second fuzzy neural network 22 is arranged so that an input value is divided into three areas G1, G2, and G3 of a fuzzy set, while the rule layer D is assembled with ANDs of all the possible linking rules, any of which is between one of the three areas G1, G2, and G3 in one of the three input values x1, x2, and x3 on one hand, and one of the three areas in either of the other two input values on the other hand.

Accordingly, the areas can be controlled individually and a control in response to a complicated change can be realized.

By preparing all the possible linking rules as mentioned above, even if an input link that does not fit the fuzzy rule obtained from the knowledge of experts, such a link can always find a matching link, and the sequential learning as have been mentioned above enables an optimal control.

Further, when the relation between the three temperatures related to the heat fixing roller 1 is either (1) UPPER LIMIT TEMP.>PREDICTED TEMP.>ACTUAL TEMP., or (2) PREDICTED TEMP.>ACTUAL TEMP.>UPPER LIMIT TEMP., or (3) ACTUAL TEMP.>PREDICTED TEMP.>UPPER LIMIT TEMP., or (4) ACTUAL TEMP.>UPPER LIMIT TEMP.>PREDICTED TEMP, the surface temperature comparing unit 12 sends a control signal to the target value setting unit 13 to adjust the weights of the first and the second fuzzy neural networks 21 and 22.

Thus, only when the three temperatures satisfy one of the relations as mentioned above, that is, relations which lead to an abnormal condition such as overshoot, the first and the second fuzzy neural networks 21 and 22 perform the learning.

Therefore, because the learning by the first and the second fuzzy neural networks 21 and 22 is not required in all the cases in which the actual temperature and the predicted temperature differ, the time for learning is saved by performing the learning only in necessary cases.

In addition, when the relation of the three temperatures concerning the heat fixing roller 1 compared by the surface temperature comparing unit 12 is either UPPER LIMIT TEMP.>PREDICTED TEMP.>ACTUAL TEMP. or ACTUAL TEMP.>UPPER LIMIT TEMP.>PREDICTED TEMP., that is, when the predicted temperature is lower than the upper limit temperature, the target value setting unit 13 sets the predicted temperature as the target value to adjust the weight of the second fuzzy neural network 22. With the target value, the actual temperature. The temperature change, and the interval between the temperature samplings, the heater on-time is computed, and the result of the computation is used as the target value to adjust the weight of the first fuzzy neural network 21.

Accordingly, whenever the predicted temperature is below the upper limit temperature, the second fuzzy neural network 22 has the predicted temperature as the target value, namely, the teaching data Ot2, to adjust the weight. And, the heater on-time which is computed based on the teaching data Ot2 is made the teaching data Ot1 for the first fuzzy neural network 21. Therefore, even if the actual temperature of the heat fixing roller 1 exceeds the upper limit temperature, an optimal on-time of the heater 2 without overshoot can be obtained.

Besides, when the relation of the three temperatures related to the heat fixing roller 1 compared by the surface temperature comparing unit 12 is either PREDICTED TEMP.>ACTUAL TEMP.>UPPER LIMIT TEMP.,or ACTUAL TEMP.>PREDICTED TEMP.>UPPER LIMIT TEMP., that is, when the upper limit temperature is lower than both the predicted temperature and the actual temperature, the target value setting unit 13 sets the upper limit temperature as the target value to adjust the weight of the second fuzzy neural network 22. The on-time of the heater 2 is computed with the target value thus found, the actual temperature, the temperature change, and the interval between temperature samplings. The heater on-time is used as a target value to adjust the weight of the first fuzzy neural network 21.

Thus, whenever the upper limit temperature is below both the actual temperature and the predicted temperature, the second fuzzy neural network 22 has the upper limit temperature as the teaching data Ot2 to adjust the weight. Also the heater on-time computed based on the teaching data Ot2 is also made the teaching data Ot1 of the first fuzzy neural network 21. Accordingly, the actual surface temperature of the heat fixing roller 1 never exceeds the upper limit temperature, whereby overshoot is prevented by thus obtaining an optimal on-time of the heater 2.

Therefore, the target value setting unit 13 sets up the target values as the teaching data Ot1 and Ot2 respectively for the first and the second fuzzy neural networks 21 and 22 only in necessary occasions based on the result of the temperature comparison by the surface temperature comparing unit 12, whereby the number of learned data sets is reduced. Thus the time required for learning is minimized and the flexibility in setting a target value is enhanced.

In addition, even though only not more than 10 sets of the data on past detection and computation by each of the units are used as learning data for the first and the second fuzzy neural networks 21 and 22, the heat fixing device of the present embodiment can precisely control the on-time of the heater 2. Therefore, the memory size of the memory unit 10 can be reduced, while because the number of data to be learned is small, the time for learning can be decreased.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A heater control device for controlling a heater whose heat is conducted to heat-radiating means and emitted from said heat-radiating means, comprising:

temperature detecting means for detecting a surface temperature of said heat-radiating means;

temperature change outputting means for outputting a change in a surface temperature of said heat-radiating means, during a predetermined period of time;

heater on-time computing and controlling means, provided with a first fuzzy neural network for learning to minimize an error between a first target value and an actual output when the first target value is given as a teaching data, for computing and controlling the heater on-time in response to said temperature detecting means and said temperature change outputting means by use of said first fuzzy neural network;

predicting means, provided with a second fuzzy neural network for learning to minimize an error between a second target value and an actual output when the second target value is given as a teaching data, for predicting a surface temperature of said heat-radiating means at next detection of the surface temperature when said heater is turned on and controlled in response to the heater on-time, by use of said second fuzzy neural network, in response to said temperature detecting means, said temperature change outputting means, and said heater on-time computing and controlling means;

judging means for comparing a predetermined upper limit temperature of the surface of said heat-radiating means, the predicted surface temperature computed by said predicting means, and an actual surface temperature detected by said temperature detecting means, and for judging whether or not said first and second fuzzy neural networks should carry out the learning; and target value setting means for setting the first and second target values with respect to said first and second fuzzy neural networks respectively, based on the upper limit surface temperature, the predicted surface temperature, and the actual temperature, when said judging means judges to carry out the learning.

2. The heater control device as set forth in claim 1, wherein said target value setting means computes a heater on-time and sets the heater on-time as the first target value, the heater on-time being computed in accordance with the second target value, the actual temperature, the temperature change, and a period between surface temperature detections, and being necessary to obtain the second target value.

3. The heater control device as set forth in claim 2, wherein said first target value represented as Ot1 satisfies the following equation;

$$Ot1 = \frac{Ot2 - T - \Delta Toff \cdot t}{\Delta Ton - \Delta Toff}$$

where the second target value is represented as Ot2, the actual temperature as T, the period between the surface temperature detections as t, a temperature change during the heater on-time as ΔTon, and a temperature change during an off-time of said heater as ΔToff.

4. The heater control device as set forth in claim 1, wherein said first fuzzy neural network includes an input layer, a membership layer, a rule layer and an output layer, and all the links between said layers have respective weights.

5. The heater control device as set forth in claim 4, wherein said input layer and said membership layer are arranged so that values of the actual surface temperature and the temperature change are respectively divided into three areas of a fuzzy set, and said rule layer is assembled with ANDs of all possible linking rules between the three areas of the actual surface temperature value and three areas of the temperature change value.

6. The heater control device as set forth in claim 1, wherein said second fuzzy neural network includes an input layer, a membership layer, a rule layer, and an output layer, and all the links between said layers have respective weights.

7. The heater control device as set forth in claim 6, wherein said input layer and said membership layer are arranged so that values of the actual surface temperature, the temperature change, and the heater on-time are divided into three areas of a fuzzy set, and said rule layer is assembled with ANDs of all possible linking rules, any of which is between one of the three areas of one of the above three values and one of the three areas of either of the other two values.

8. The heater control device as set forth in claim 1, wherein said first and second fuzzy neural networks adjust weights of respective nodes when the first and second target values are given, so as to minimize respective errors between the target values and actual outputs.

9. The heater control device as set forth in claim 8, wherein said first and second fuzzy neural networks include adjusting means for adjusting, among weights of links of said respective fuzzy neural networks, at least a weight of a link useful for minimizing errors between the teaching data and the output, based on a backpropagation rule for adjusting the weights of links of said respective fuzzy neural networks in order from the weights of links on an output side to those on an input side while referring to the errors between the teaching data and the output.

10. The heater control device as set forth in claim 1, wherein said judging means further includes comparing three temperature values of said heat-radiating means, three temperatures being the predetermined upper limit temperature, the actual surface temperature, the predicted surface temperature, and outputting a control signal to said target value setting means, so that the first and second target values are set, the control signal being outputted when the three temperatures satisfy one of following relations:

upper limit temp.>predicted temp.>actual temp., predicted temp.>actual temp.>upper limit temp., actual temp.>predicted temp.>upper limit temp., and actual temp.>upper limit temp.>predicted temp.

11. The heater control device as set forth in claim 10, wherein said target value setting means further includes setting the predicted surface temperature as the second target value, when the three temperatures of said heat-radiating means, i.e., the predetermined upper limit temperature, the actual surface temperature, and the predicted surface temperature, satisfy one of following relations:

upper limit temp.>predicted temp.>actual temp., and actual temp.>upper limit temp.>predicted temp.

12. The heater control device as set forth in claim 10, wherein said target value setting means further includes setting the upper limit temperature as the second target value when the three temperatures of said heat-radiating means, i.e., the predetermined upper limit temperature, the actual surface temperature, and the predicted surface temperature, satisfy one of following relations:

predicted temp.>actual temp.>upper limit temp., and actual temp.>predicted temp.>upper limit temp.

13. A heater control device as set forth in claim 1, further comprising memory means for recording learning data such as results of detection by said temperature detecting means, outputs from said temperature change outputting means, results of computation by said heater on-time computing and controlling means, and results of computation by said predicting means, wherein said target value setting means sets the first and second target values in accordance with the learning data.

14. The heater control device as set forth in claim 13, wherein said memory means has a storage region for recording at least 1 and at most 10 sets of the latest learning data.

15. The heater control device as set forth in claim 1 is employed in a heat fixing device which comprises heat radiating means and a heater for heating said heat radiating means.

* * * * *